US007832034B2

(12) United States Patent
Liu et al.

(10) Patent No.: US 7,832,034 B2
(45) Date of Patent: Nov. 16, 2010

(54) PILLOW COVER WITH NECK SUPPORT

(76) Inventors: Fong Yu Liu, 18559 Stonegate La., Rowland Heights, CA (US) 91748; Lisa Wang Arnold, 18559 Stonegate La., Rowland Heights, CA (US) 91748

( * ) Notice: Subject to any disclaimer, the term of this patent is extended or adjusted under 35 U.S.C. 154(b) by 0 days.

(21) Appl. No.: 12/286,623

(22) Filed: Sep. 30, 2008

(65) Prior Publication Data

US 2010/0077551 A1 Apr. 1, 2010

(51) Int. Cl.
*A47G 9/10* (2006.01)

(52) U.S. Cl. ..... 5/636; 5/640; 5/645; 5/490; 5/644

(58) Field of Classification Search ..... 5/636, 5/639, 640, 644, 645, 490
See application file for complete search history.

(56) References Cited

U.S. PATENT DOCUMENTS

| | | | | | |
|---|---|---|---|---|---|
| 247,892 | A * | 10/1881 | Doremus | 5/640 |
| 395,043 | A * | 12/1888 | Doremus | 5/640 |
| 2,896,227 | A * | 7/1959 | Reed | 5/644 |
| 3,648,308 | A * | 3/1972 | Greenawalt | 5/632 |
| 4,393,530 | A * | 7/1983 | Stark | 5/640 |
| 4,550,459 | A * | 11/1985 | Endel et al. | 5/640 |
| 4,754,513 | A * | 7/1988 | Rinz | 5/490 |
| 4,829,614 | A * | 5/1989 | Harper | 5/644 |
| 4,908,894 | A * | 3/1990 | Sanders | 5/640 |
| 4,956,886 | A * | 9/1990 | Sarkozi | 5/640 |
| 5,020,174 | A * | 6/1991 | Sarkozi | 5/640 |
| 5,586,350 | A * | 12/1996 | Thonnessen et al. | 5/636 |
| 6,490,743 | B1 * | 12/2002 | Adat et al. | 5/645 |
| 6,691,352 | B2 * | 2/2004 | Wang | 5/636 |
| 2002/0138908 | A1 * | 10/2002 | Wang | 5/636 |
| 2010/0077551 | A1 * | 4/2010 | Liu et al. | 5/636 |

FOREIGN PATENT DOCUMENTS

DE 3835212 A1 * 5/1990

* cited by examiner

*Primary Examiner*—Robert G Santos
(74) *Attorney, Agent, or Firm*—Raymond Y. Chan; David and Raymond Patent Firm

(57) ABSTRACT

A pillow cover includes a pillow casing and a neck support provided thereon. A neck support includes an elongated retention pocket and a neck supporting element received in the retention pocket therewithin. The user is able to use his or her own pillow to incorporate with the pillow cover such that when the user sleeps in a bed by using his or her own pillow for head support in a comfortable way, the neck support of the pillow cover provides a substantial neck support to keep the neck of the user in alignment with the spine while sleeping.

19 Claims, 6 Drawing Sheets

PILLOW COVER WITH NECK SUPPORT

BACKGROUND OF THE PRESENT INVENTION

1. Field of Invention

The present invention relates to a pillow cover, and more particularly to a pillow cover with neck support, wherein the user is able to use his or her own pillow to incorporate with the pillow cover such that when the user sleeps in a bed by using his or her own pillow for head support in a comfortable way, the neck support of the pillow cover provides a substantial neck support to keep the neck of the user in alignment with the spine while sleeping.

2. Description of Related Arts

Nowadays, pillows have become indispensable tools of in our lives. They usually used for providing support for the head while sleeping in a bed. A pillow can also be just a decoration such as a throw pillow. It is usually having filler inside made from feathers, synthetic fills, and so on. Through sleeping on the pillow, people can feel very relax and comfortable, and achieve the desired sleeping effect. However, although there are thousands of pillows in market, each pillow stores may only provide a very general style. In other words, people pursue for the pillow which is being smaller for people to carry on with them, more personal style, and more convenient and comfortable for people to use.

The traditional pillows usually comprise a pillow cover to cover on top of the pillow. Because the pillow cover is changeable, it provides a way to change the appearance of the pillows and always keeps the pillows clean. Even through constantly and long terms using, the pillows in the pillow covers still remains in good condition. However, when the user wants to adjust the height and the position of the pillow, the present pillow always can only make slightly change. In other words, every pillow user would like to adjust different height and position of their pillows so as to ensure which style fits his or her head the most to achieve the most comfortable way while sleeping in a bed.

Therefore, there is a kind of adjustable pillow, called memory pillow sold on the market, comprising memory foam, wherein the memory is made of polyurethane with additional chemicals that increase its viscosity level and density. Thus, when the user sleep on the memory pillow, the memory pillow automatically adjust its height and position to fit the user's head so as to make people feel more comfortable while sleeping in a bed. However, even though the memory foam pillow is flexible in its shape to fit the user's head, the memory foam pillow has several drawbacks. The main drawback of the memory foam pillow cannot be selectively adjusted its stiffness. Accordingly, some users may prefer to use the pillow having softer supportive ability. However, such memory foam pillow can only provide a standard softness. In addition, the memory foam pillow is too heavy and bulky. For example, when people go out for traveling, a conventional pillow or such memory pillow which is already making a good adjustment of its shape is not allowable for them to carry on with them. Thus, the user still needs to use the pillow provided by the hotel room. To make matters worse, through constantly and long terms using, some pillows go out of shape very easily such that people will feel not so comfortable while sleeping on it. It is a struggle for people to decide whether to keep the deformed pillow or get a new one.

To sum up, the design of existing pillows cannot satisfy the current needs of people who like to have their individual style on pillows and pursue the most comfortable manner while they sleep in a bed.

SUMMARY OF THE PRESENT INVENTION

A main object of the present invention is to provide a pillow cover with a neck support, wherein the user is able to use his or her own pillow to incorporate with the pillow cover such that when the user sleeps in a bed by using his or her own pillow for head support in a comfortable way, the neck support of the pillow cover provides a substantial neck support to keep the neck of the user in alignment with the spine while sleeping.

Another object of the present invention is to provide a pillow cover with a neck support, wherein the geographic position of the neck support on the pillow casing is changeable and replaceable. Therefore, every pillow user is able to adjust its geographic position of their pillows so as to ensure which style fits his or her head the most to achieve the most comfortable way while sleeping in a bed.

Another object of the present invention is to provide a pillow cover with a neck support, wherein the retention pocket has a side opening which is adapted for receiving the neck supporting element to allow the placement of different kinds of stuffing in the neck support such that the user can easily adjust the neck support's height and change contact feeling.

Another object of the present invention is to provide a pillow cover with a neck support, which is adapted for the placement of different kinds of decorative patterns such that the pillow can easily expand its appearance and improve personal hygiene.

Another object of the present invention is to provide a pillow cover with a neck support, wherein the size of the pillow cover is extremely portable such that the user is able to always carry them especially in the travel time. In other words, the user is able to carry the pillow cover only and to incorporate with any existing pillow provided by others, such as hotel.

Another object of the present invention is to provide a pillow cover with a neck support, wherein the neck supporting element comprises an inflatable bag and a valve provided thereon for popping the inflatable bag by air inflation. Thus, the volume of the neck supporting element is further reduced by air inflation method, and the pillow has become extremely portable.

Accordingly, in order to accomplish the above objects, the present invention provides a pillow cover comprising a pillow casing and a neck support.

The pillow casing comprises a top layer and a bottom layer overlapping therewith, and defining a pillow cavity between the top and bottom layers for receiving a pillow in the pillow cavity.

The neck support comprises an elongated retention pocket longitudinally provided at the top layer and a neck supporting element receiving in the retention pocket at a position that the neck supporting element is upwardly protruded from the top layer, in such a manner that the neck supporting element is adapted for providing a natural support at a neck of a user when a head of the user supports on the pillow. Therefore, the user is able to sleep in a bed by using his or her own pillow for head support in a comfortable way while the neck support of the pillow cover provides a substantial neck support to keep the neck of the user in alignment with the spine while sleeping.

These and other objectives, features, and advantages of the present invention will become apparent from the following detailed description, the accompanying drawings, and the appended claims.

DETAILED DESCRIPTION OF THE PREFERRED EMBODIMENT

Figure 1:
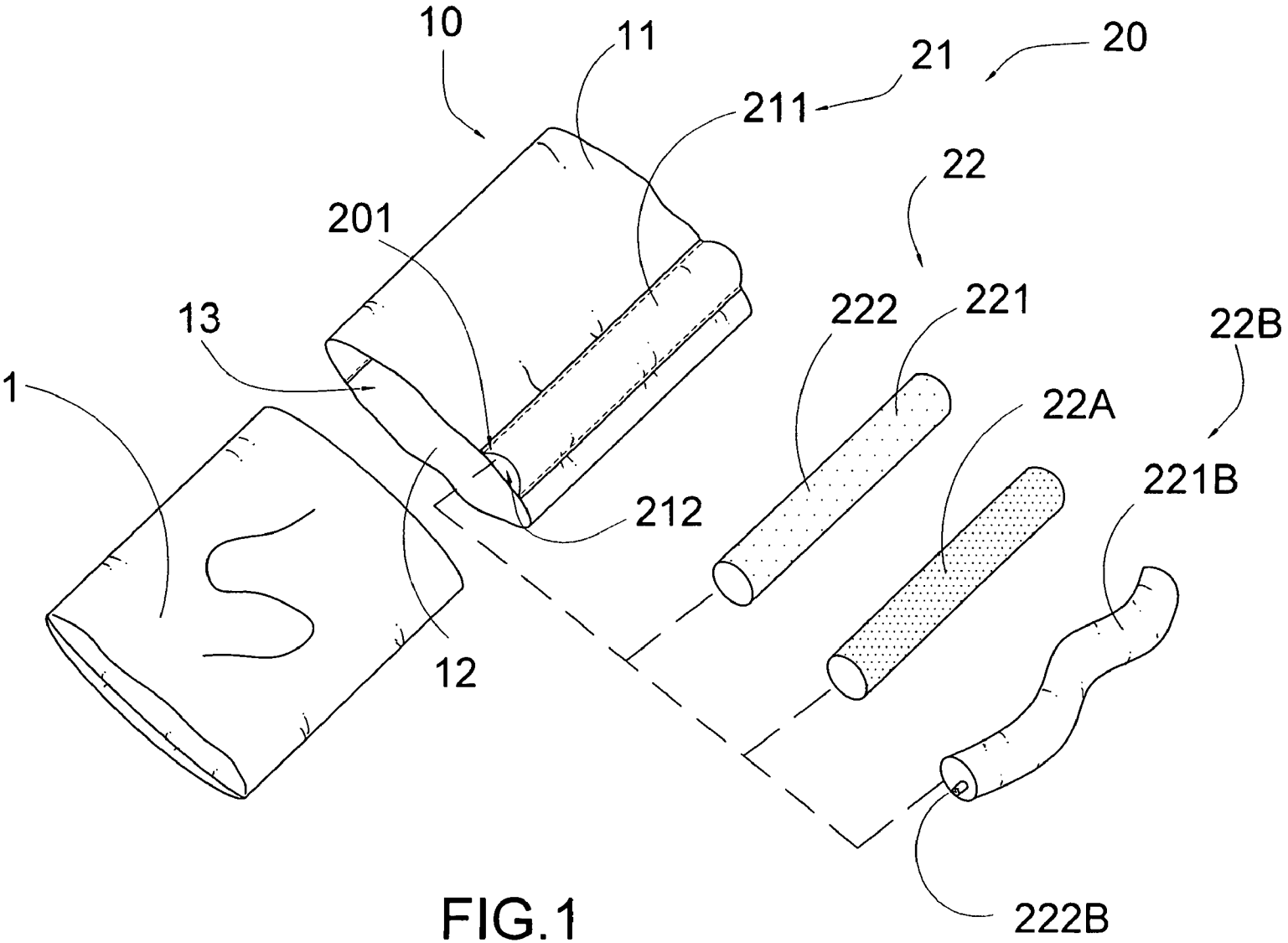
FIG. 1 is an exploded perspective view of a pillow cover with a neck support according to a preferred embodiment of the present invention, illustrating the alternatives of the neck supporting element.
Figure 2:
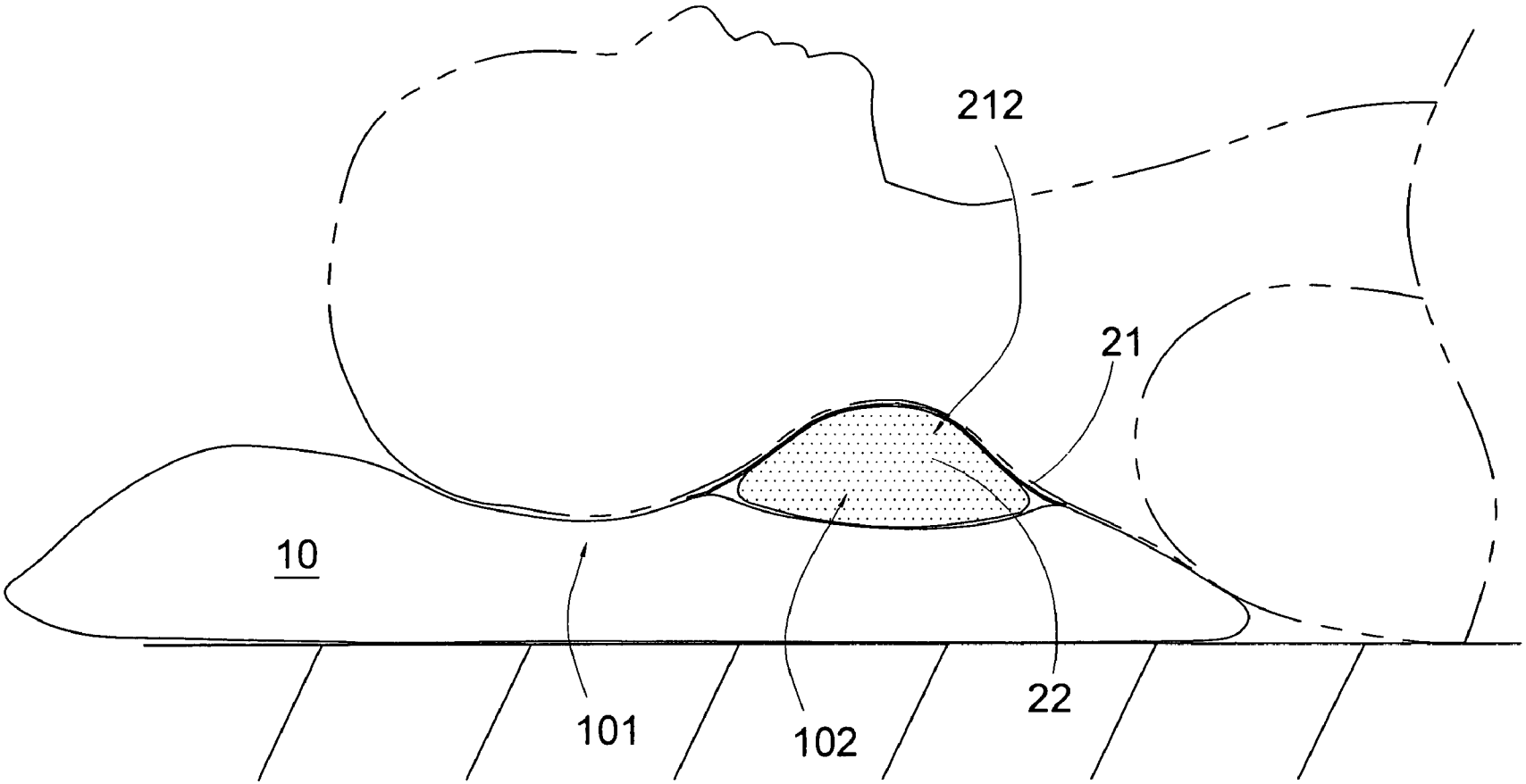
FIG. 2 is a side view of the pillow receiving in the pillow cover according to the above preferred embodiment of the present invention, illustrating the head and neck support of the user by the pillow and the neck support of the present invention.
Figure 3:
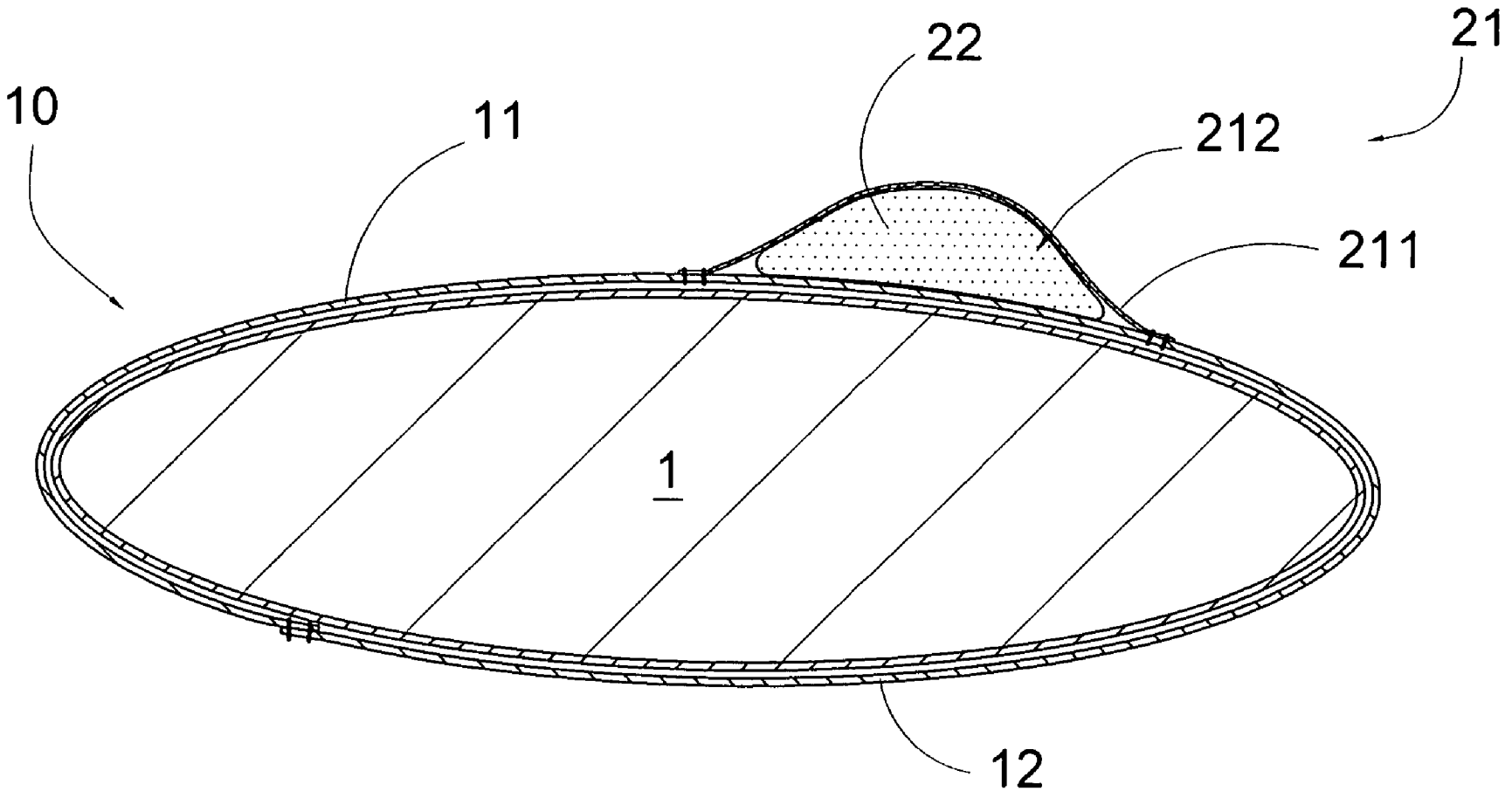
FIG. 3 is a sectional view of the pillow cover with the neck support incorporating with the traditional pillow according to the above preferred embodiment of the present invention.
Figure 4:
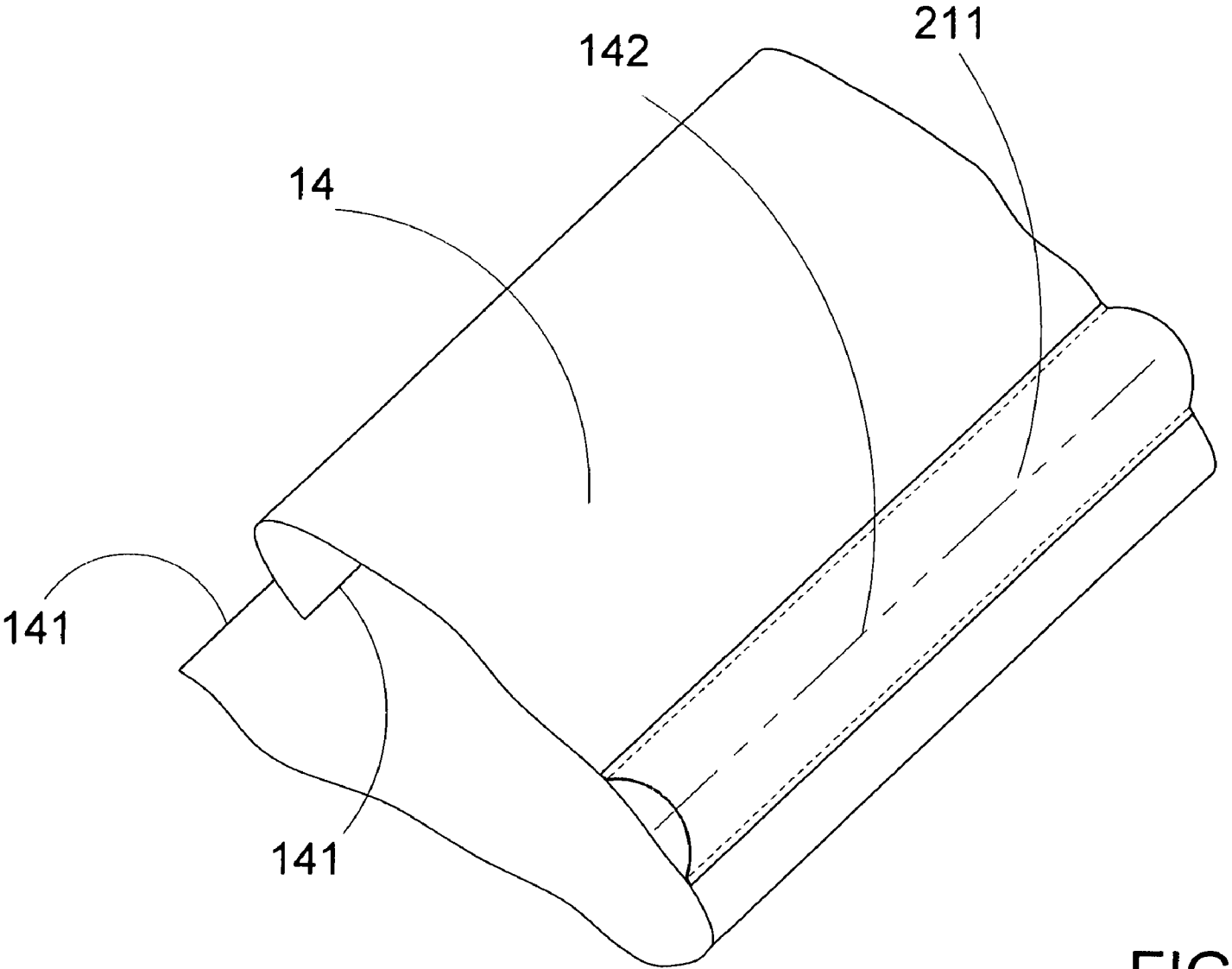
FIG. 4 illustrates the structural configuration of the pillow cover according to the above preferred embodiment of the present invention.

Referring to FIGS. 1 to 3 of the drawings, a pillow cover according to a preferred embodiment of the present invention is illustrated, wherein the pillow cover comprises a pillow casing 10 and a neck support 20.

The pillow casing 10 has a top layer 11 and a bottom layer 12 overlapping therewith and defines a pillow cavity 13 between the top and bottom layers 11, 12, wherein a traditional pillow element 1 is adapted to be received in the pillow cavity 13 of the pillow casing 10.

The neck support 20 comprises an elongated retention pocket 21 longitudinally provided at the top layer 11 of the pillow casing 10 and a neck supporting element 22 receiving in the retention pocket 21 at a position that the neck supporting element 22 is upwardly protruded from the top layer 11, in such a manner that the neck supporting element 22 is adapted for filling at a neck curvature of a user to provide a natural neck support for the user when a head of the user supports on the pillow element I so as to keep the neck of the user in alignment with the spine while sleeping.

Accordingly, the pillow element 1, which is a traditional pillow, comprises a pillow envelop and a filler filled therein, wherein the filler is generally made of down, feathers, or synthetic fills. According to the preferred embodiment, the user is able to dispose his or her own pillow in the pillow cover such that the user is able to sleep in a bed by using his or her own pillow for head support in a comfortable way.

According to the preferred embodiment, the pillow casing 10 is made of non-irritant, comfortable, and launderable material, such as woven fabric or cotton, to provide a relatively close fitting and to provide a soft surface in contact with the body of the user. The pillow casing 10 can be washable after the pillow element 1 is removed from the pillow casing 10 for hygiene purpose.

As shown in FIG. 2, the pillow casing 10 has a head support portion 101 defined at a center portion of the top layer 11 for the head of the user lying thereat and a neck support portion 102 adjacent to the head support region 101 at a position between two longitudinal ends of the top layer 11 to align with the neck curvature of the user. Therefore, when the pillow element 1 is disposed in the pillow casing 10, the head of the user is supported by the pillow element 1 at the head support portion 101 of the pillow casing 10 while the neck of the user is supported by the neck support 20 at the neck support portion 102 of the pillow casing 10.

As shown in FIGS. 1 and 2, the retention pocket 21 has at least a side accessing opening 201 for the neck supporting element 22 replaceably receiving in the retention pocket 21 through the side accessing opening 201. An attachment, such as Velcro, can be provided at the side accessing opening 201 to enclose the neck supporting element 22 in the retention pocket 21.

In particularly, the retention pocket 21 comprises a pocket layer 211 overlapped on an outer surface of the top layer 11 of the pillow casing 10 to define an elongated pocket cavity 212 between the pocket layer 211 and the outer surface of the top layer 11 for retaining the neck supporting element 22 in the pocket cavity 212, as shown in FIG. 3. Preferably, two longitudinal edges of the pocket layer 211 are stitched on the top layer 11 of the pillow casing 10 at the neck support region 102 thereof while at least one of the transverse edges of the pocket layer 211 is remained unsewn to form the side accessing opening 201. Therefore, the neck supporting element 22 is adapted to dispose in the pocket cavity 212 through the side accessing opening 201.

Figure 5:
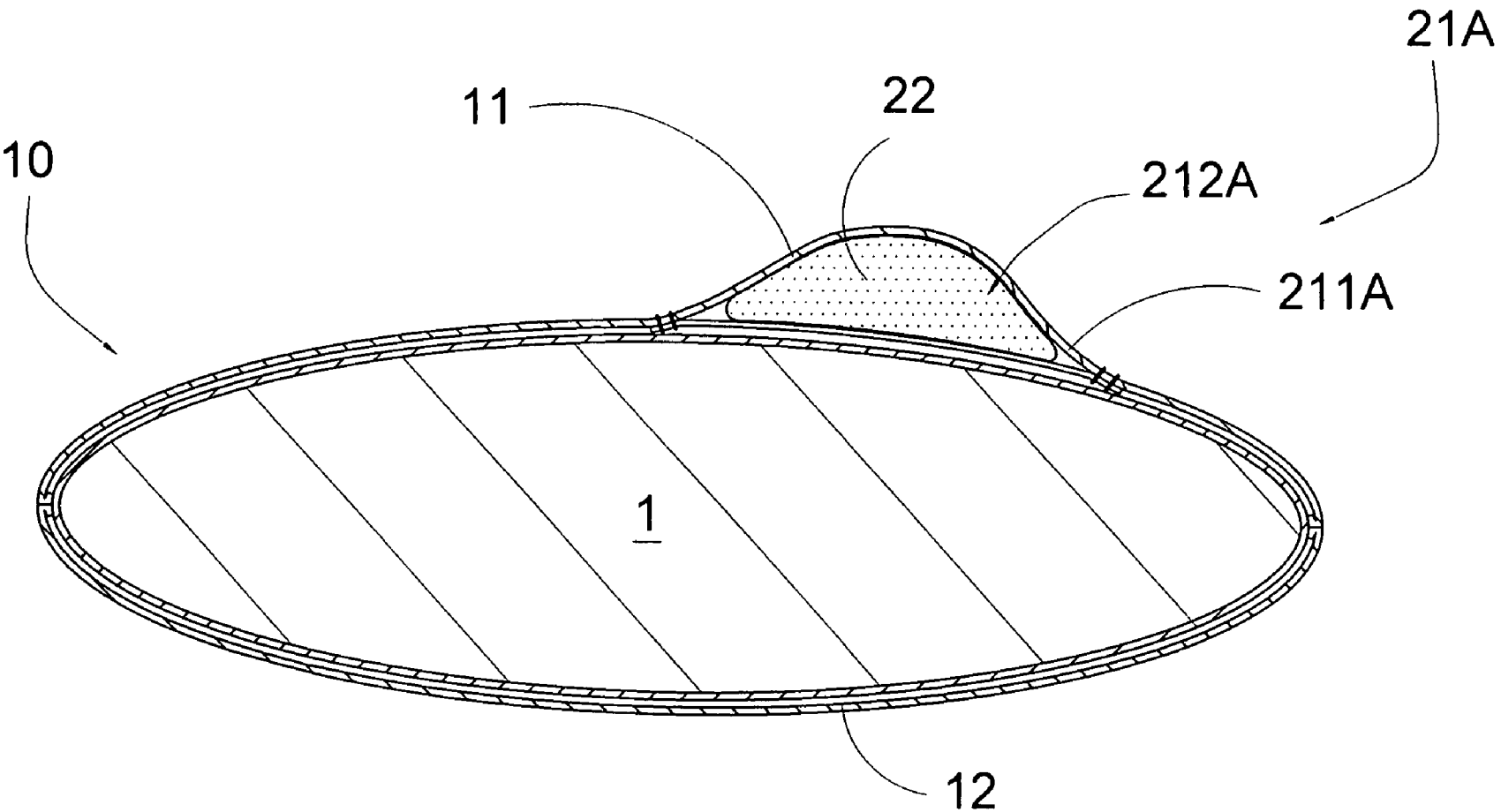
FIG. 5 illustrates an alternative mode of the retention pocket of the pillow cover according to the above preferred embodiment of the present invention.

FIG. 5 illustrates an alternative mode of the retention pocket 21A, wherein the retention pocket 21 A comprises a pocket layer 211 A overlapped on an inner surface of the top layer 11 of the pillow casing 10 to define an elongated pocket cavity 212A between the pocket layer 211A and the inner surface of the top layer 11 for retaining the neck supporting element 22 in the pocket cavity 212A. In other words, the retention pocket 21 A is formed within the pillow cavity 13 in a hidden manner, so as to keep the aesthetic appearance of the pillow casing 10.

As shown in FIG. 1, the neck supporting element 22, which is made of deformable material, has a top curved supporting surface having a curvature matching with a curvature of the neck of the user to fittingly support the neck of the user at the top curved supporting surface. Accordingly, the neck supporting element 22, having an elongated structure corresponding to the pocket cavity 212, comprises a tubular pillow bag 221 and a pillow filler 222 filled in the pillow bag 221. The pillow filler 222 can be made of made of down, feathers, or synthetic fills. Accordingly, the pillow filler 222 can also be made of activated carbon for air purification, herbs such as Lavender or Rosemary, or beans depending on the user's preference.

Alternatively, the neck supporting element 22A comprises an elongated foam detachably received in the pocket cavity 212, wherein the neck supporting element 22A is preferably made of memory foam. Likewise, the neck supporting element 22B comprises an inflatable bag 221B and a valve 222B provided thereon for popping the inflatable bag 221B by air inflation. Accordingly, the stiffness of the neck supporting element 22B can be selectively adjusted by retaining a desired volume of air in the inflatable bag 221B. Once the inflatable bag 221B is deflated, the pillow cover can be folded into a relatively small size for enhancing the portability of the pillow cover.

It is worth to mention that the neck supporting elements 22, 22A, 22B are replaceable and interchangeable such that the user is able to choose the corresponding neck supporting element 22, 22A, 22B for neck support according to the user preference. Therefore, the user is able to select and adjust different stiffness of the neck supporting elements 22, 22A, 22B for neck support.

In order to manufacture the pillow cover of the present invention, the pillow casing 10 comprises a piece of fabric layer 14 folded in half and stitched along two longitudinal edges 141 as a connection line to form the top and bottom layers 11, 12, wherein the retention pocket 21 is provided at the fabric layer 211 along a centerline 142 between the two longitudinal edges 141 such that the connection line always located at the bottom layer 12 while the neck supporting element 22 is retained at the top layer 11.

Preferably, two transverse edges of the fabric layer 14 are remained unsewn to form two side openings of the pillow casing 10 such that the pillow element 1 is adapted to receive in the pillow cavity 13 through one of the side openings. Accordingly, the neck supporting element 22 is selectively adjusted to its geographic location with respect to the pillow element 1 by encirclingly shifting the pillow casing 10 around the pillow element 1. Therefore, the user is able to re-locate the geographic location of the neck supporting element 22 to fittingly support the neck of the user with respect to the curvature and contour of the neck of the user during sleeping. Accordingly, one of the side openings of the pillow casing 10 can also be sewn that one side of the pillow casing 10 forms an opening side while another side of the pillow casing 10 forms a closed side.

It is appreciated that the pillow casing 10 comprises two fabric layers overlapped with each other that the longitudinal edges of the fabric layers are sewn with each other as shown in FIG. 5 to define the top and bottom layers 11, 12.

Figure 6:
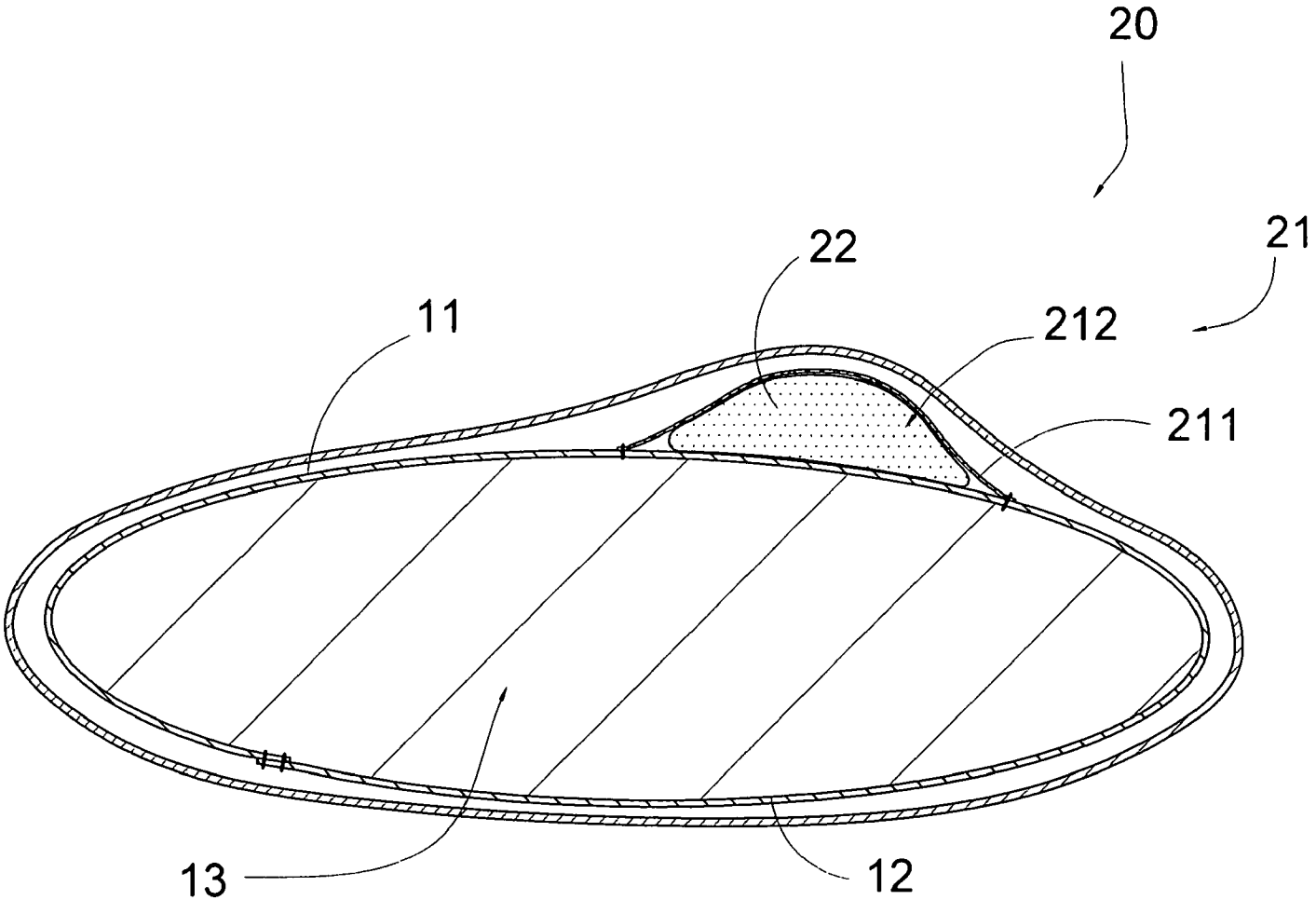
FIG. 6 illustrates an alternative mode of the pillow cover according to the above preferred embodiment of the present invention.

It is appreciated that the pillow casing 10 forms as the pillow envelope that the filler is directly filled into the pillow casing 10, as shown in FIG. 6, so as to omit the pillow envelope of the traditional pillow element 1. Therefore, the pillow element 1 is embodied as the filler only to receive in the pillow casing 10. In other words, the top and bottom layers 11, 12 of the pillow casing 10 are affixed edge-to-edge that two side openings of the pillow casing 10 are sewn to retain the filler in the pillow cavity 13 such that the pillow casing 10 with the filler therein becomes a head support with built-in neck support ability.

It is worth to mention that the user is able to keep his or her own pillow element 1 in order to incorporate with the pillow cover of the present invention because of his or her own sleeping habit. In compassion with the traditional pillow, the size of the pillow cover of the present invention is relatively portable. Therefore, the user is able to carry the pillow cover of the present invention only during traveling. For example, the user is able to dispose the pillow element 1 provided by the hotel in the pillow cover of the present invention such that the neck support 20 of the pillow cover provides a substantial neck support to keep the neck of the user in alignment with the spine while sleeping. The user does not have to carry his or her own large pillow during traveling in order to provide the neck support function. In addition, it would be more personal hygiene that the user uses the pillow cover of the present invention to cover the pillow from the hotel.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A pillow cover, comprising:

a pillow casing comprising a length, a width, a top layer and a bottom layer overlapping therewith, and defining a pillow cavity between said top and bottom layers for receiving a pillow element in said pillow cavity, and has a head support portion for a head of a user lying thereat, and a neck support portion positioned adjacent to said head support portion to align with said neck curvature of said user; and a neck support provided on said pillow casing at a position that said neck support is upwardly protruded from said top layer, wherein said neck support comprises an elongated retention pocket extending along the length of the pillow casing, having a width substantially less than the width of the pillow casing, and being longitudinally provided at said top layer and a neck supporting element fitted in said elongated retention pocket and extending along the length of the pillow casing to upwardly protrude from said top layer for filling at a neck curvature of a user to provide a natural neck support for said user when said head of said user supports on said pillow element, wherein said neck supporting element is retained at said neck support portion for substantially supporting a neck portion of said user, wherein said retention pocket has a side accessing opening for said neck supporting element replaceably receiving in said retention pocket through said side accessing opening, wherein said retention pocket comprises a pocket layer overlapped on and fixed relative to an outer surface of said top layer to define an elongated pocket cavity between said pocket layer and said outer surface of said top layer for retaining said neck supporting element in said pocket cavity.

2. The pillow cover, as recited in claim 1, wherein said neck supporting element, which is made of deformable material, has a top curved supporting surface having a curvature matching with a curvature of the neck of the user.

3. The pillow cover, as recited in claim 1, wherein said neck supporting element comprises a tubular pillow bag and a pillow filler filled in said pillow bag.

4. The pillow cover, as recited in claim 2, wherein said neck supporting element comprises a tubular pillow bag and a pillow filler filled in said pillow bag.

5. The pillow cover, as recited in claim 2, wherein said neck supporting element comprises an elongated foam.

6. The pillow cover, as recited in claim 3, wherein said neck supporting element comprises an elongated foam.

7. The pillow cover, as recited in claim 4, wherein said neck supporting element comprises an elongated foam.

8. The pillow cover, as recited in claim 2, wherein said neck supporting element comprises an inflatable bag and a valve provided thereon for popping said inflatable bag by air inflation.

9. The pillow cover, as recited in claim 4, wherein said neck supporting element comprises an inflatable bag and a valve provided thereon for popping said inflatable bag by air inflation.

10. The pillow cover, as recited in claim 7, wherein said neck supporting element comprises an inflatable bag and a valve provided thereon for popping said inflatable bag by air inflation.

11. The pillow cover, as recited in claim 4, wherein said neck supporting element is selectively adjusted to its geographic location with respect to said pillow element by encirclingly shifting said pillow casing around said pillow element.

12. The pillow cover, as recited in claim 7, wherein said neck supporting element is selectively adjusted to its geographic location with respect to said pillow element by encirclingly shifting said pillow casing around said pillow element.

13. The pillow cover, as recited in claim 10, wherein said neck supporting element is selectively adjusted to its geographic location with respect to said pillow element by encirclingly shifting said pillow casing around said pillow element.

14. The pillow cover, as recited in claim 7, wherein said top and bottom layers of said pillow casing are affixed edge-to-edge to provide a side opening for receiving said pillow element which comprises a pillow envelope and a filler filled therein.

15. The pillow cover, as recited in claim 10, wherein said top and bottom layers of said pillow casing are affixed edge-to-edge to provide a side opening for receiving said pillow element which comprises a pillow envelope and a filler filled therein.

16. The pillow cover, as recited in claim 13, wherein said top and bottom layers of said pillow casing are affixed edge-to-edge to provide a side opening for receiving said pillow element which comprises a pillow envelope and a filler filled therein.

17. The pillow cover, as recited in claim 7, wherein said top and bottom layers of said pillow casing are affixed edge-to-edge for receiving said pillow element which comprises a filler filled in said pillow casing.

18. The pillow cover, as recited in claim 10, wherein said top and bottom layers of said pillow casing are affixed edge-to-edge for receiving said pillow element which comprises a filler filled in said pillow casing.

19. The pillow cover, as recited in claim 13, wherein said top and bottom layers of said pillow casing are affixed edge-to-edge for receiving said pillow element which comprises a filler filled in said pillow casing.

* * * * *